US005562082A

United States Patent [19]

Norppa et al.

[11] Patent Number: 5,562,082

[45] Date of Patent: Oct. 8, 1996

[54] ENGINE CYCLE IDENTIFICATION FROM ENGINE SPEED

[75] Inventors: Eric M. Norppa; Richard J. Tkaczyk, both of Carmel, Ind.

[73] Assignee: Delco Electronics Corp., Kokomo, Ind.

[21] Appl. No.: 406,425

[22] Filed: Mar. 20, 1995

[51] Int. Cl.[6] ..... F02P 5/14

[52] U.S. Cl. ..... 123/424

[58] Field of Search ..... 123/414, 424, 123/421, 419, 418, 416, 417; 73/116

[56] References Cited

U.S. PATENT DOCUMENTS

| | | | |
|---|---|---|---|
| 4,594,981 | 6/1986 | Gloss et al. | 123/424 |
| 5,054,447 | 10/1991 | Fukui et al. | 123/414 |
| 5,197,430 | 3/1993 | Hoshiba et al. | 123/421 |
| 5,311,773 | 5/1994 | Bradshaw et al. | 73/116 |
| 5,325,833 | 6/1994 | Fukui et al. | 123/414 |
| 5,383,434 | 1/1995 | Kugler et al. | 123/419 |
| 5,448,976 | 9/1995 | Treinies et al. | 123/419 |
| 5,452,604 | 9/1995 | Namaki et al. | 73/116 |

*Primary Examiner*—Raymond A. Nelli
*Attorney, Agent, or Firm*—Mark A. Navarre

[57] ABSTRACT

An internal combustion engine has a crankshaft sensor with an uneven tooth spacing to identify an index tooth corresponding in position to top dead center (TDC) of the number 1 cylinder. A microprocessor based engine controller determines from the sensor pulses each TDC event. During cranking, the number 1 cylinder compression stroke is detected from engine speed variations by measuring time periods over sample ranges before and after TDC. When a compression stroke occurs just before TDC, the period before TDC is greater than the period after TDC, whereas other TDC events are evidenced by the period before TDC being smaller than or equal to the period after TDC.

8 Claims, 3 Drawing Sheets

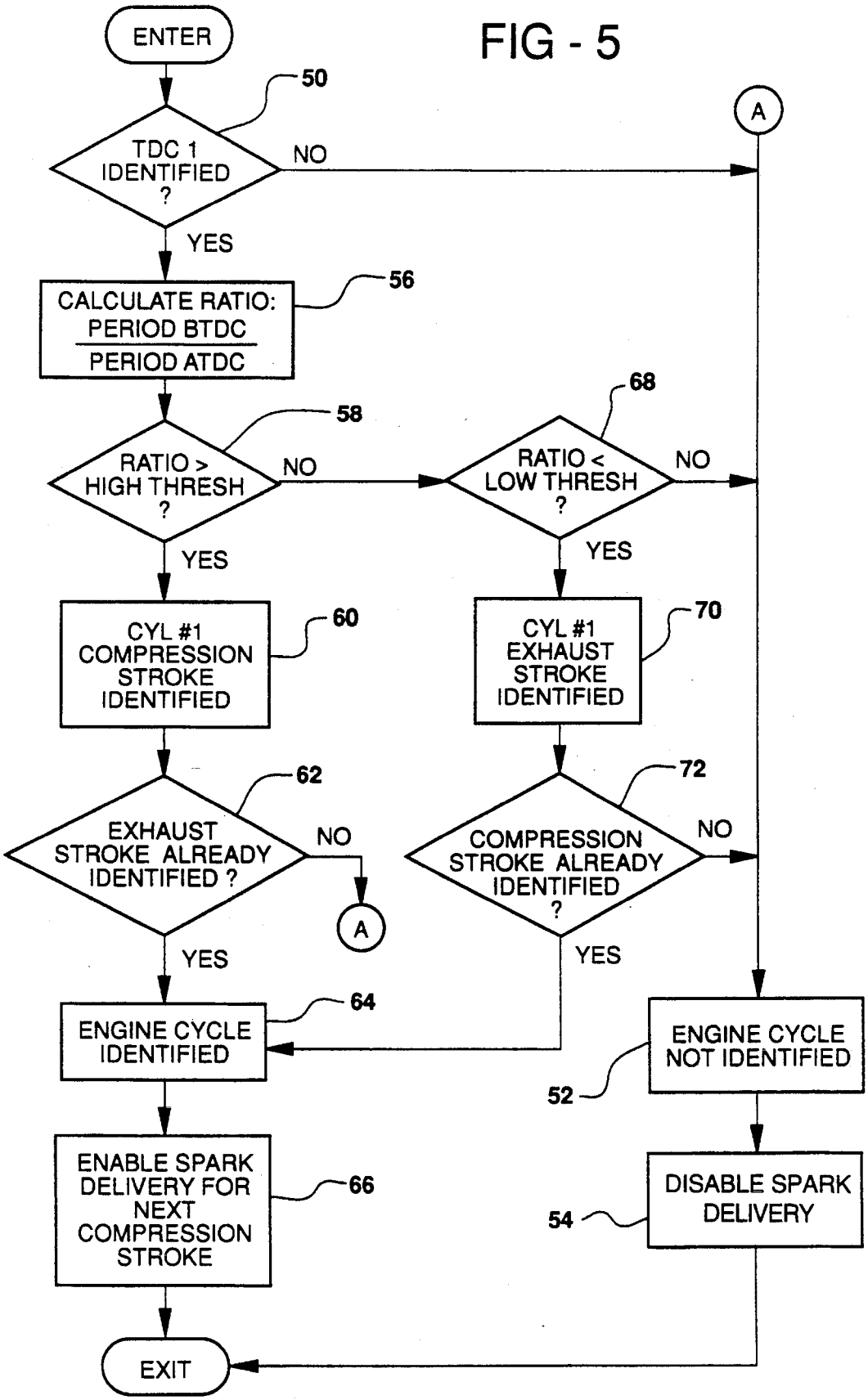
FIG - 5
ENTER
50
TDC 1 IDENTIFIED ?
NO
YES
A
CALCULATE RATIO: PERIOD BTDC / PERIOD ATDC
56
58
RATIO > HIGH THRESH ?
NO
YES
68
RATIO < LOW THRESH ?
NO
YES
CYL #1 COMPRESSION STROKE IDENTIFIED
60
CYL #1 EXHAUST STROKE IDENTIFIED
70
62
EXHAUST STROKE ALREADY IDENTIFIED ?
NO
A
YES
72
COMPRESSION STROKE ALREADY IDENTIFIED ?
NO
YES
ENGINE CYCLE IDENTIFIED
64
ENGINE CYCLE NOT IDENTIFIED
52
ENABLE SPARK DELIVERY FOR NEXT COMPRESSION STROKE
66
DISABLE SPARK DELIVERY
54
EXIT

ENGINE CYCLE IDENTIFICATION FROM ENGINE SPEED

FIELD OF THE INVENTION

This invention relates to control of internal combustion engines during starting and particularly to a method and apparatus for initially determining the compression stroke of a cylinder.

BACKGROUND OF THE INVENTION

Control of a four stroke engine requires that a spark be applied during a compression stroke. Since the engine turns two revolutions, and thus reaches top dead center (TDC) twice each engine cycle, it is necessary to distinguish which occurrence of TDC follows the compression stroke and which occurrence follows the exhaust stroke.

Conventionally, an engine is equipped with two sensors, one rotating with the crankshaft to determine accurate crankshaft position, and one rotating with the camshaft to provide a cylinder identification pulse once every two crankshaft revolutions. Position timing information for each cylinder is derived from the synchronization of these two sensors. It would be preferable, however to use only one sensor. The use of two sensors is more expensive than one as well as consuming more space. The use of two sensors also lowers overall system reliability simply because there are more components for potential failure. In some applications it is desirable to minimize both the cost and the size of the engine, and of course improving reliability usually a desired goal.

SUMMARY OF THE INVENTION

It is therefore an object of the invention to identify the engine cycle in a four-stroke internal combustion engine using only a single engine angular position sensor. Another object is to determine the position timing information of such an engine during engine cranking.

It is proposed to use a single engine position sensor which comprises a wheel rotating with the crankshaft and fitted with notches or teeth (hereinafter called teeth) sensible by a stationary pickup transducer which produces an electrical pulse upon the passage of each tooth. An index tooth identifies TDC for the no. 1 cylinder of the engine. The teeth are evenly spaced except that a missing tooth or an extra tooth adjacent the index tooth which gives a different pulse spacing to mark the index pulse for TDC identification. Thus for one cylinder each TDC event is readily furnished to a controller. The controller must determine which TDC event is associated with a compression stroke. This is accomplished during engine cranking without spark application by sampling the engine speed before and after TDC and identifying the compression stroke as the upstroke having lower speed than the ensuing down stroke.

The controller is a microprocessor based device which receives each input pulse from the sensor and records its time of arrival, and is programmed to determine the periods over equal engine rotation angles just before and just after each TDC. It then compares the periods to find out whether the period before TDC is larger than the period after TDC; if so, the period before TDC is the compression stroke. Then the spark is enabled to fire in each subsequent compression stroke. The controller counts pulses to determine each time the no. 1 cylinder is in its compression stroke. Based on this information and the designated firing order, the compression time of each other cylinder is calculated. Well known algorithms are then employed to control the precise spark time within each compression stroke.

BRIEF DESCRIPTION OF THE DRAWINGS

The above and other advantages of the invention will become more apparent from the following description taken in conjunction with the accompanying drawings wherein like references refer to like parts and wherein:

FIG. 5 is a flow chart illustrating a program for identifying engine cycle, according to the invention.

DESCRIPTION OF THE INVENTION

The ensuing description is directed to a cycle identification method and apparatus developed for use in a small engine of, say, one or two cylinders, but it is equally applicable to a wide range of engine sizes and types except for an even firing engine with an even number of cylinders.

Figure 1:
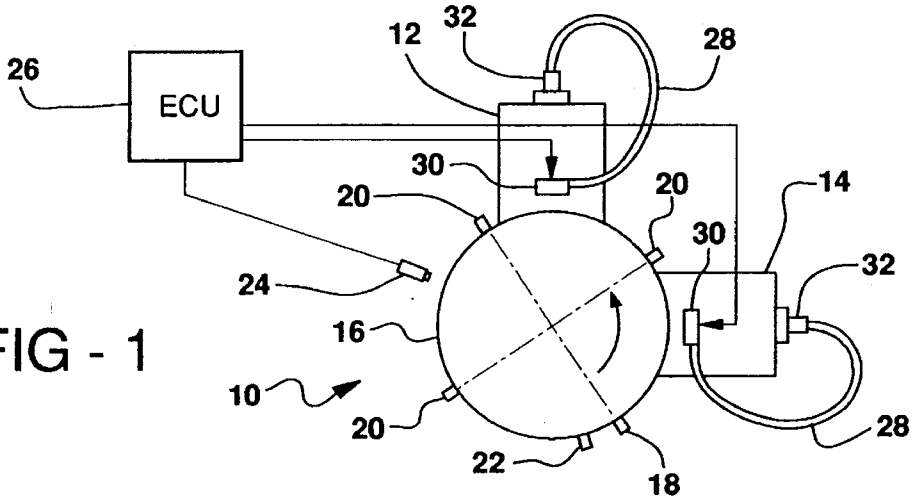
FIG. 1 is a schematic view of an internal combustion engine with a crankshaft position sensor according to the invention.

FIG. 1 shows a two-cylinder engine 10 having cylinders 12 and 14, with cylinder 12 selected as cylinder number 1. A sensor wheel 16 fixed to the crankshaft, not shown, for rotation therewith has an index tooth 18 and three other teeth 20 all spaced at 90° intervals around the sensor wheel 16, and a fifth tooth 22 close to the index tooth 18. This is a simple but practical illustration of a sensor wheel; variations would include peripheral wheel notches instead of teeth, or a large number of evenly spaced teeth and an extra tooth or a missing tooth preferably adjacent the index tooth. A crankshaft position sensor 24 positioned adjacent the path of the teeth produces an electrical pulse which is coupled to an engine control unit (ECU) 26. The ECU 26 is a microprocessor based controller which controls engine functions such as spark timing. Spark output wires 28 are connected to ignition coils 30 for spark plugs 32 of each cylinder.

Figure 2:
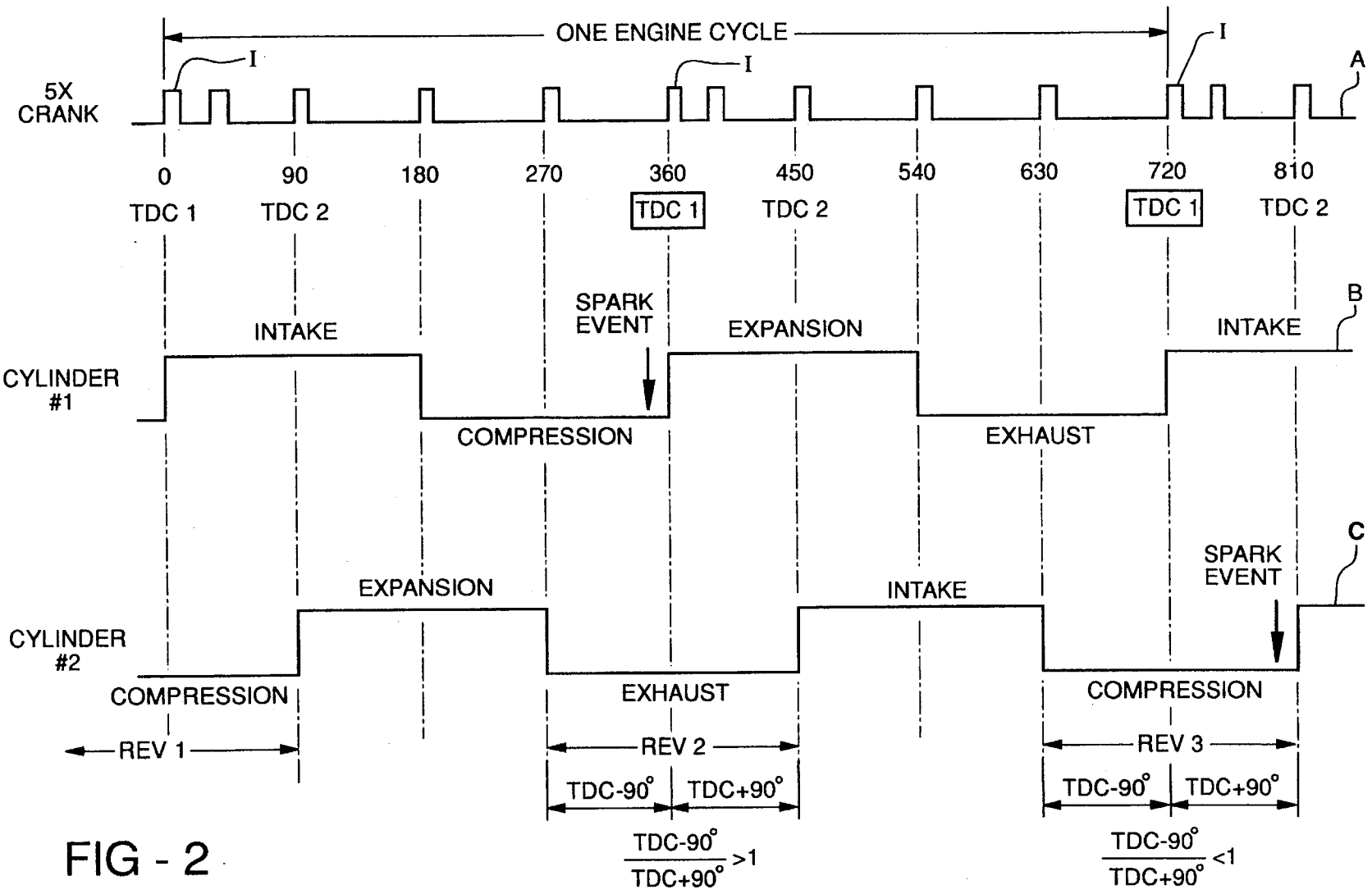
FIG. 2 is a position timing diagram of the engine of FIG. 1.

The engine timing diagram, as shown in FIG. 2, includes in line A the sensor pulses produced during an engine cycle. Line B shows the duration of each of the intake, compression, expansion and exhaust strokes of cylinder number 1, and line C similarly shows the strokes for cylinder number 2, which are angularly offset from the strokes of cylinder number 1. For each cylinder a top dead center (TDC) occurs at the transitions of the compression and expansion strokes and of the exhaust and intake strokes. The index pulse I of the sensor, identified by the following short pulse space, marks each TDC event of cylinder number 1. The index pulse does not distinguish between the TDC following compression from that following exhaust. That distinction is critical since the spark event for each cylinder must be timed in conjunction with the compression event for that cylinder.

The compression stroke is identified on the basis of engine speed variations during cranking before the spark function is enabled. During the compression stroke the engine rotation slows down due to the pressure building up in the cylinder, and during the following expansion or power stroke the engine gains speed due to the cylinder pressure.

By measuring the time period of rotation through a fixed range before TDC and a similar range after TDC, it can be seen that the time variation (and thus the speed) between those ranges is readily apparent. The period before TDC is somewhat greater than the period after TDC and this relationship is useful as a detector of the compression/expansion portion of the engine cycle. Similar measurements made during the exhaust/intake portion of the cycle for a single cylinder engine do not reveal a speed difference since the cylinder pressure is low at that time. In the case of the two cylinder engine described above, the second cylinder is in its exhaust stroke when cylinder number 1 is at the compression/expansion transition, as shown in FIG. 2 at REV 2 so that it does not influence the measured periods. However, during REV 1 and REV 3 the second cylinder is in its compression stroke when the periods are being measured. Then the engine will be slowing such that the measured period after TDC will be longer than the period before TDC; accordingly this condition is easily distinguished from the REV 2 condition where the engine is rotating faster after the TDC.

Figure 3:
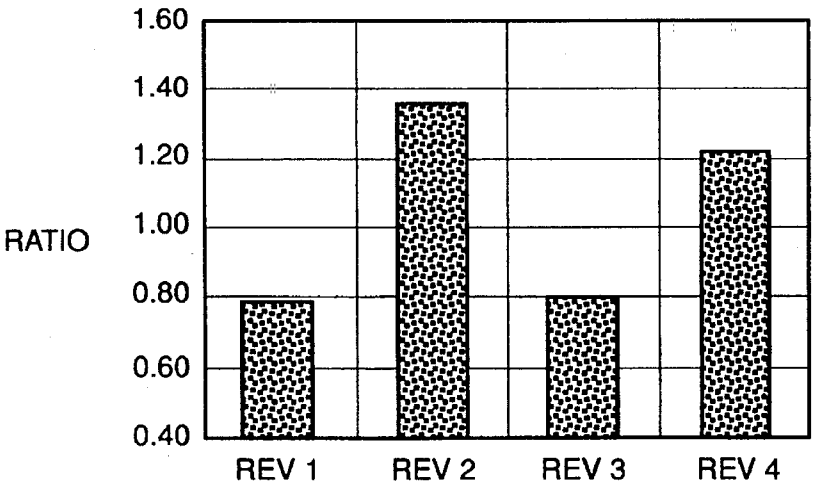
FIG. 3 is a graph showing ratios of measured time periods according to the invention.

The speed change may be detected by subtracting the measured period after TDC from the period before TDC and noting the difference. If the difference exceeds an empirically determined threshold, that TDC is determined to be at the compression/expansion transition. It is preferred, however, to calculate the ratio of the period before TDC to the period after TDC. If this ratio is greater than unity (or some other threshold) the TDC is determined to be at the compression/expansion transition, thereby identifying the engine cycle. For the two cylinder example, the ratio calculated at REV 1 and REV 3 will be less than unity and can be used to verify the identification of the engine cycle. FIG. 3 illustrates the results of tests on the two cylinder engine. The calculated ratio for the REV 1 and REV 3 transitions is typically on the order of 0.8, and the ratio for REV 2 and REV 4 transitions is usually about 1.2. The preferred measurement ranges are the crank angles between TDC and 90° before TDC (BTDC) and between TDC and 90° after TDC (ATDC), referred to here as TDC–90° and TDC+90°, respectively, as indicated in FIG. 2.

The ECU microprocessor is programmed with algorithms to interpret the sensor pulses to first identify TDC events and then to identify the engine cycle, i.e. determine which TDC occurs at the compression/expansion transition of the number 1 cylinder. This occurs during cranking before sparks are supplied to the engine and preferably is concluded within one engine cycle. Once that has been accomplished, a software counter can track the sensor pulses to determine in each engine cycle and for each cylinder when the compression stroke occurs and which TDC is associated with it. The algorithms are illustrated by flow charts in FIGS. 4 and 5 wherein the functional description of each block in the chart is accompanied by a number in angle brackets <nn> which corresponds to the reference number of the block.

Figure 4:
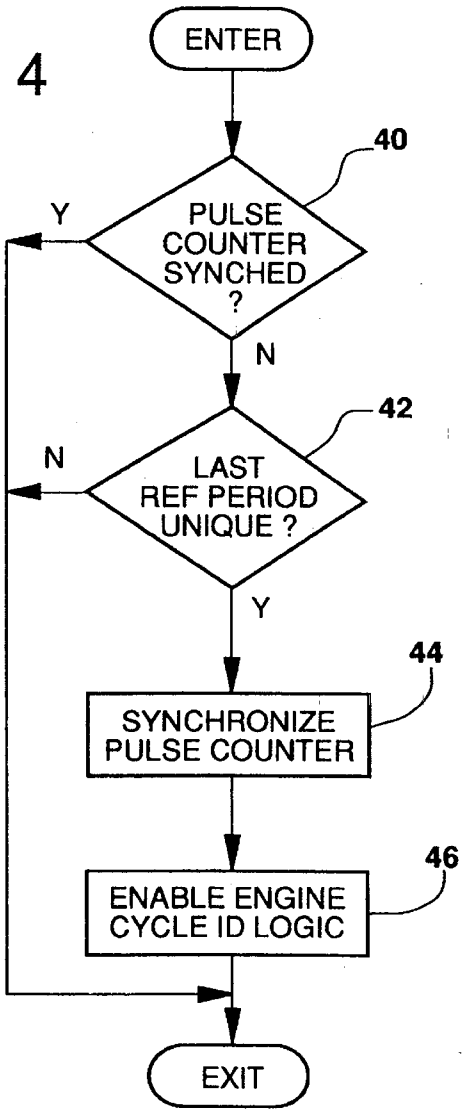
FIG. 4 is a flow chart illustrating a program for identifying cylinder top dead center.

Referring to FIG. 4, a flow chart illustrates a program for identifying the TDC pulses which is entered upon receipt of each sensor pulse. The specific purpose of the program is to identify the TDC pulse and then synchronize a pulse counter with it so that the count can provide a frame of reference for engine operations. The pulse counter is used to count teeth on the sensor wheel for triggering spark and fuel injection events for each cylinder. According to the algorithm, if the pulse counter is already synchronized <40> the program is exited, and if not it is determined whether the last period between pulses is longer or shorter than normal periods to signify that the index tooth (or notch) is detected <42>. If the period is unique, the pulse counter is synchronized with the index pulse <44> and then the engine cycle identification logic of FIG. 5 is enabled <46>.

In FIG. 5, the program for identifying the engine cycle (or which TDC follows a compression stroke) is entered once per crankshaft revolution at the end of the measurement period following a TDC pulse. The program is executed twice to separately determine the compression stroke as well as the exhaust stroke for verification. The logic first checks whether the TDC for cylinder number 1 has been identified <50>. If not, the engine cycle is not identified <52> and spark delivery is disabled <54>. If the TDC is identified, the ratio of the measured periods before and after TDC is calculated <56>. If the ratio is greater than a threshold, which may be unity, <58>, the compression stroke for cylinder number 1 is identified as the stroke before TDC <60>. If the exhaust stroke also has been identified <62> the engine cycle identification is completed <64> and the spark delivery is enabled for the next compression stroke <66>. If the exhaust stroke has not been identified <62> the program exits via blocks 52 and 54. If the ratio was not above the threshold <58> it is compared to a low threshold <68>; if it is below the low threshold the exhaust stroke is identified <70> and if the compression stroke has been identified <72> then the engine cycle is identified <64>. If the ratio is not below the low threshold <68> or the compression stroke has not been identified <72>, the engine cycle remains unidentified <52>and the spark remains disabled <54>. Then the program is exited and reentered after the next TDC event.

The check of correct ratios for both the compression and exhaust strokes provides a robust algorithm to assure correct cycle identification. Still, if desired, the check for exhaust stroke can be omitted and full reliance placed on the compression stroke determination. The threshold for each comparison may be unity or an empirical determination of a suitable threshold may be made for each type of engine. For example the high threshold might be 1.1 or 1.2 while the low threshold could be 0.9 or 0.8.

Although good results are obtained by measuring periods based on crank ranges of 90° before and after TDC, other ranges may be selected for detecting the changes in engine speed due to compression. Particularly where the sensor has a large number of teeth, there are a variety of ranges before and after TDC which would result in valid speed comparisons.

It will thus be appreciated that this invention eliminates the necessity of a camshaft sensor for indicating the engine cycle and that simple software determination along with a suitable crankshaft sensor can be used instead. It is expected that during cranking the engine cycle determination will be made with certainty within one engine cycle, although the system is not limited to that.

The embodiments of the invention in which an exclusive property or privilege is claimed are defined as follows:

1. An ignition timing control method for a four-stroke cycle internal combustion engine having a crankshaft position sensor arranged to yield, in each four-stroke cycle, a plurality of pulses including a TDC pulse for each occurrence of a top dead center (TDC) crankshaft position for a given engine cylinder, said control method comprising the steps of:

identifying, based on said plurality of pulses, first and second crank angles respectively before and after each of said TDC pulses;

measuring an elapsed time for each of said first and second crank angles while cranking said engine without applying a spark ignition voltage to said engine;

comparing said elapsed times and identifying a compression stroke TDC pulse as a TDC pulse for which said measured elapsed time of said first crank angle is longer than said measured elapsed time of said second crank angle;

synchronizing an ignition signal with said identified compression stroke TDC pulse; and thereafter applying said spark ignition voltage to said engine based on said synchronized ignition signal.

2. The invention as defined in claim 1 wherein said first and second crank angles are defined by said TDC pulses and pairs of said pulses at equal crank angles before and after each of said TDC pulses.

3. The invention as defined in claim 2 wherein said first and second crank angles are approximately 90 degrees before and after said TDC pulse.

4. The invention as defined in claim 1 wherein:

the step of comparing said elapsed times and identifying a compression stroke TDC pulse comprises:

calculating a ratio of said elapsed time of said first crank angle to said elapsed time of said second crank angle; and identifying a compression stroke TDC pulse when said calculated ratio exceeds a predetermined threshold.

5. The invention as defined in claim 4 wherein said predetermined threshold is one.

6. An ignition timing control method for a four-stroke cycle internal combustion engine having a crankshaft position sensor arranged to yield, in each four-stroke cycle, a series of pulses including a TDC pulse for each occurrence of a top dead center (TDC) crankshaft position for a given engine cylinder, said control method comprising the steps of:

identifying each TDC pulse, and defining, using said series of pulses, first and second crank angles respectively before and after each of said identified TDC pulses;

measuring an elapsed time for each of said first and second crank angles while cranking said engine without applying a spark ignition voltage to said engine;

comparing said elapsed times of said first and second crank angles for a first of said identified TDC pulses, and determining that said first identified TDC pulse is a compression stroke TDC pulse if a ratio of said compared elapsed times exceeds a first predetermined threshold;

synchronizing an ignition signal with said first identified TDC pulse; and thereafter applying a spark ignition voltage to said engine based on said synchronized ignition signal.

7. The invention as defined in claim 6, additionally comprising the step of:

additionally comparing said elapsed times of said first and second crank angles for a second of said identified TDC pulses, and determining that said second identified TDC pulse is an exhaust stroke TDC pulse if a ratio of said additionally compared elapsed times is less than a second predetermined threshold, thereby verifying that said first identified TDC pulse is compression stroke TDC pulse.

8. An ignition timing control method for a four-stroke cycle internal combustion engine having a crankshaft position sensor arranged to yield, in each four-stroke cycle, a series of pulses including a TDC pulse for each occurrence of a top dead center (TDC) crankshaft position for a given engine cylinder, said control method comprising the steps of:

identifying each TDC pulse, and defining, using said series of pulses, first and second crank angles respectively before and after each of said identified TDC pulses;

measuring an elapsed time for each of said first and second crank angles while cranking said engine without applying a spark ignition voltage to said engine;

comparing said elapsed times of said first and second crank angles for each of said identified TDC pulses, and determining that a given one of said identified TDC pulses is a compression stroke TDC pulse if said elapsed times for said given identified TDC pulse are indicative of deceleration of said engine prior to said given identified TDC pulse and acceleration of said engine after said given identified TDC pulse;

synchronizing an ignition signal with said first identified TDC pulse; and thereafter applying a spark ignition voltage to said engine based on said synchronized ignition signal.

* * * * *